US005529394A

United States Patent [19]

Davoren

[11] Patent Number: 5,529,394

[45] Date of Patent: Jun. 25, 1996

[54] PACKING BAG AND FILL-SEAL PROCESS

[76] Inventor: Gerard A. Davoren, 3217 Tania Cresent, Burlington, Ontario, Canada, L7M 3N3

[21] Appl. No.: 399,633

[22] Filed: Mar. 7, 1995

Related U.S. Application Data

[62] Division of Ser. No. 123,929, Sep. 20, 1993, Pat. No. 5,417,040.

[51] Int. Cl.[6] ..... B65D 33/34

[52] U.S. Cl. ..... 383/61; 383/9; 383/104; 383/120; 383/122

[58] Field of Search ..... 383/9, 61, 67, 383/104, 120, 122, 205, 206, 66, 121, 107

[56] References Cited

U.S. PATENT DOCUMENTS

| | | | |
|---|---|---|---|
| 2,401,109 | 5/1946 | Rohdin | 383/122 X |
| 3,228,583 | 1/1966 | Dougherty | 383/9 |
| 3,300,120 | 1/1967 | McColgan | 383/9 |
| 3,935,993 | 2/1976 | Doyen et al. | 383/104 X |
| 4,290,467 | 9/1981 | Schmidt | 383/9 |
| 4,524,459 | 6/1985 | Titchenal | 383/122 X |
| 5,059,036 | 10/1991 | Richison et al. | 383/61 |
| 5,112,138 | 5/1992 | Peppiatt | 383/61 X |
| 5,215,380 | 6/1993 | Custer et al. | 383/61 |

FOREIGN PATENT DOCUMENTS

| | | | |
|---|---|---|---|
| 0416194 | 3/1991 | European Pat. Off. | 383/67 |
| 0240651 | 10/1991 | Japan | 383/61 |
| 403289451 | 12/1991 | Japan | 383/104 |
| 404006044 | 1/1992 | Japan | 383/121 |
| 92021582 | 12/1992 | WIPO | 383/120 |

*Primary Examiner*—Jes F. Pascua
*Attorney, Agent, or Firm*—McConnell and Fox

[57] ABSTRACT

A one piece flat bottomed gusseted bag is provided which may be bottom filled and flat sealed. This structure permits a resealable bag to be filled and sealed without opening the resealable seal. The bag is formed with a revertive pocket at the bottom extending transversely from one side seam of the bag to the other and completely sealed at its ends to the side seams The pocket may be formed before or after sealing. The shape and attachment of the pocket is such as to produce a flat gusseted bottom on the bag when the bag is filled and the pocket forced outwards.

3 Claims, 2 Drawing Sheets

PACKING BAG AND FILL-SEAL PROCESS

This application is a division of application Ser. No. 08/123,929 filed Sept. 20, 1993, now U.S. Pat. No. 5,417,040.

FIELD OF THE INVENTION

This invention relates to gusseted resealable plastic and plastic laminate packing bags and fill processes therefore.

PRIOR ART

Bags made of plastic film or or laminates including plastic provide attractive packaging since graphics are so readily applied. Shelf display in such a manner as to present the graphics to the shopper however requires that the bag stand in a particular manner on the shelf, preferably on its bottom end. Bags intended to stand in this manner are referred to as gusseted bags since gussets are provided in their bottom end to produce a substantially flat bottom surface. Production of bottom gusseted bags is well known and typical of such bags is the bag described in U.S. Pat. No. 4,989,993.

It is also desirable that bags used for some products such as foods which may have reduced shelf life if continually exposed to the air, powdered foods, loose articles such as nuts etc. be re-sealable. Means to make the bag resealable include plastic ZIPLOC , adhesives etc.

Resealable bags, when machine filled, would, normally, be supplied from a bag manufacturer with their resealable seal closed and delivered to the fill station on the fill and seal machine up-side-down with their lower end presented to the fill station in an open condition. After filling the bag may be flat sealed at the bottom. This process however will not produce a gusseted bottom on the bag.

Alternatively, the bag may be provided with a separate bottom piece which may be sealed to the bottom of the bag after filling, to provide a flat bottom by sealing the bag around the edge of the separate bottom piece. This process however is awkward and requires special seal operations.

It is evident, therefore, that, while one piece gusseted bags have been machine filled and sealed before, they have been top filled and flat heat sealed at the top but were not resealable. On the otherhand, resealable bags would not normally be filled from the top because that would require opening the resealable seal before filling, an awkward procedure.

SUMMARY OF THE INVENTION

The present invention provides a means whereby a one piece gusseted bag, having gussets at its bottom end, and a resealable seal at its top end may be bottom filled thus not requiring opening the resealable seal and closed with a simple flat seal at its bottom end.

In one embodiment the bottom end of the bag is formed with an inwardly directed fold on one side. The folded material then folds once more and projects outwardly beyond the edge of the initial fold. The two edges, that is the edge of the other side of the bag and the outwardly projecting edge, provide an access to the interior of the bag through which material may be loaded into the bag. After loading, the outwardly projecting portion and the other side of the bag may be sealed slightly beyond the folded edge. The resulting sealed bottom is a gusseted flat bottom on which the bag may placed on a shelf.

An alternate embodiment uses a standard reclosable bag and flat seals at the bottom after bottom filling. The sealed bottom edge is folded revertively into the bottom of the bag and the side edges of the inwardly folded portion are flat sealed to the side seams of the bag. The result is, once again, a bottom gusseted bag but in this case there is a visable seam across the bottom of the bag.

Both of the foregoing forming processes result in a bag having a pocket across the bottom extending from one side seam of the bag to the other and sealed to the side seam at each of its ends. When formed the pocket is revertlye, that is the bottom of the pocket is folded into the interior of the bag. When the bag is filled the pocket is forced outwards and forms a flat base as in any gusseted bag.

A clearer understanding of my invention may be had from a consideration of the following description and drawings in which:

Figure 1:
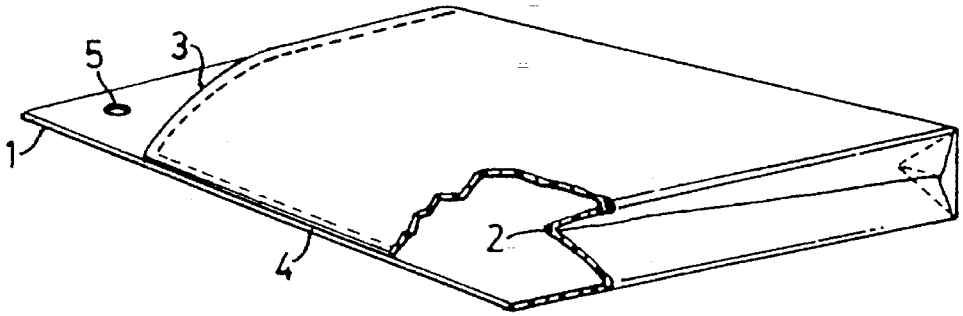
FIG. 1 (PRIOR ART)
FIG. 1 is a perspective view, partially in cross-section, of a prior art bottom gusseted top fill bag as received at the filling station.

The prior art bag shown in FIG. 1 is formed by the bag manufacturer from a continuous strip of plastic film or laminated material i which is folded, as shown in the cross-sectional portion, in a revertive fold as shown at 2 and then back up to the top edge 3 at the desired height of the bag. The strip is then sealed and separated along the sides of the bag at 4 and wicket holes, such as hole 5, punched in the upper portion.

The bags are supplied in flat form to the packager and suspended from the wickets at the fill station by the wicket holes. The bags may be opened by an air jet for filling, unfolding at the bottom as shown by the portion in section. After filling the bag may be sealed along edge 3 and the surplus, including the wicket holes cut away. The resulting bag is a standard one piece gusseted sealed bag but it does not include a resealable closure.

Figure 2:
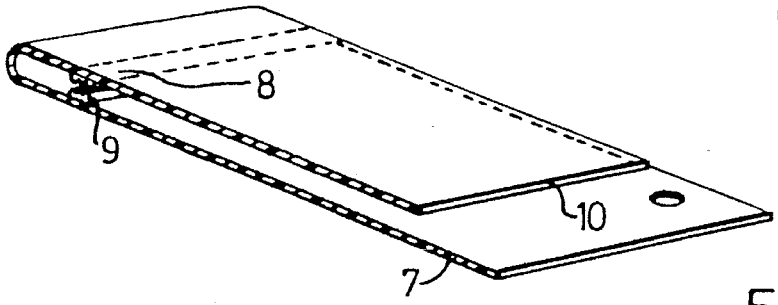
FIG. 2 (PRIOR ART)
FIG. 2 is a perspective view in section, of a reclosable bottom fill flat seal prior art bag.

FIG. 2 shows a typical one piece heat seal bag with a resealable closure. As in the previous example, the bag is formed by the bag manufacturer from a strip of plastic film or laminated material folded over, but in this case a resealable strips 8 and 9 are bonded to the strip below the fold which defines the top of the bag. The bottom of the bag is defined by the edge 10. The strip is sealed and separated along the edges of the bag and wicket holes punched as before. The bag, as before, is supplied to the packager in flat form. Bags, suspended by the wicket holes, are presented to the fill station, opened, filled, flat sealed at the bottom along edge 10, and the surplus, including the wicket holes, cut off. As will be evident the resulting bag is resealable but the bottom is not gusseted.

PREFERRED EMBODIMENTS

Figure 3:
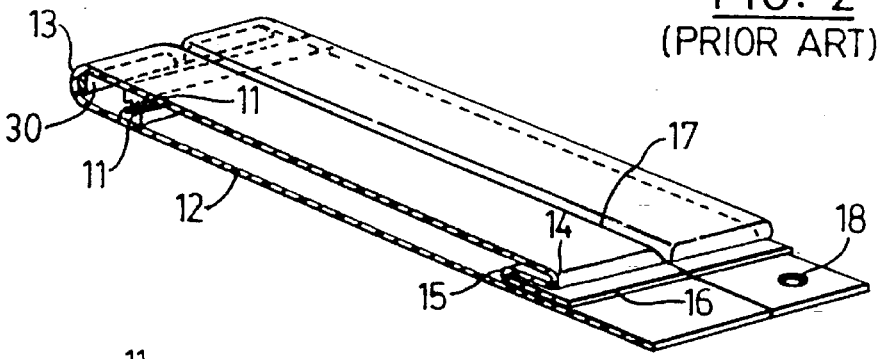
FIG. 3 is a perspective view, in section, of a bag of one embodiment of this invention as received at the fill station.

FIG. 3 shows a cross-section of the strip used by the bag manufacturer to form a bag in accordance with this invention. The strip 12 is provided with a resealable strip 11 bonded to the strip on each side of the fold 13 which defines the upper end of the bag as in the case of the prior art bag shown in FIG. 2. A tear strip 30 may be bonded to the strip at fold 13 to make an opening more convenient. One portion of the strip is folded inwardly at its edge at 14 and then outwardly at 15 so that the edge of the strip 16 projects slightly beyond the fold 14. The strip is then sealed and separated along the sides of the bags at 17 and a series of wicket holes, 18 punched in the other portion of the strip. The bags, so formed by the manufacturer, are provided to the packager.

Figure 4:
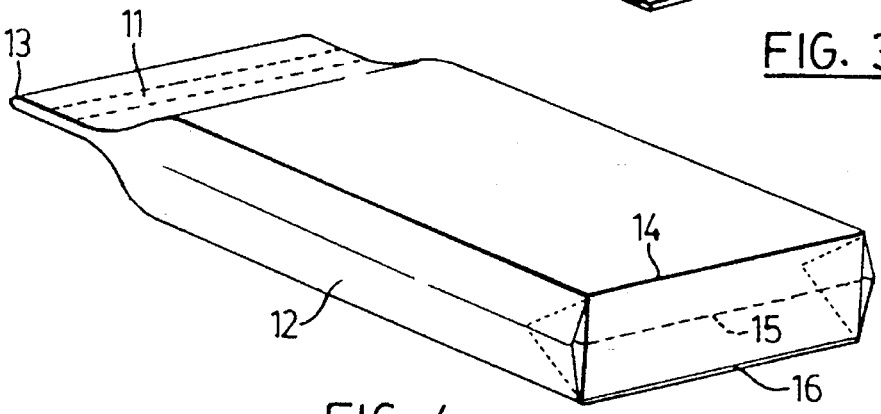
FIG. 4 is a perspective view of the bottom of the bag of FIG. 3 after sealing and filling.

The packager suspends the bags at the fill station by the wicket holes opened along edge 16 and the fill material is poured into the bag between the edge 16 and the other portion of the strip while it is suspended from the wicket. When filled, the edge 16 is heat sealed to the portion containing the wicket holes taking care not to seal fold 14 to the other portion. The surplus having been cut away, the filled bag, as shown in FIG. 4, is complete with a gusseted bottom and a resealable strip at its upper end. To open, the user cuts through fold 13, which may be provided with a tear strip, and opens the resealable seal to obtain the contents. After use the bag may be reclosed by reengaging the resealable strip 11.

While the surplus containing the wicket holes is shown as cut away it may be desirable to retain this portion as a carrying handle at the bottom of the bag and fold it over when shelving. Alternatively the folded portion between fold 13 and the resealable strip 11 may be extended, and perforated to provide a handle.

An alternate process using a simpler bag formation but a more complex forming process is illustrated in FIGS. 5–8.

Figure 5:
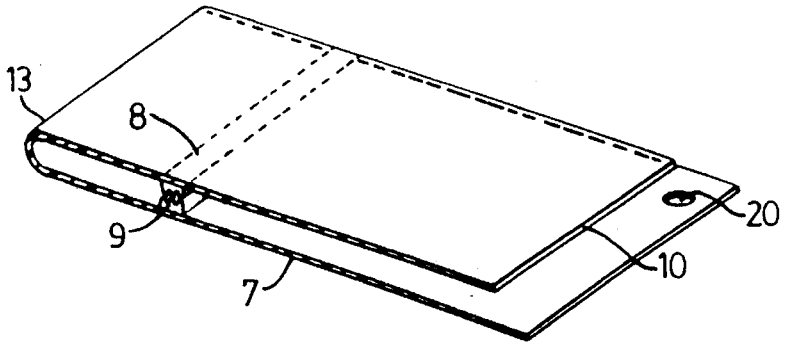
FIG. 5 is a perspective view, in section, of an alternate form of bag which produces essentially the same bottom formation as the bag of FIG. 1, after sealing and reforming.
Figure 6:
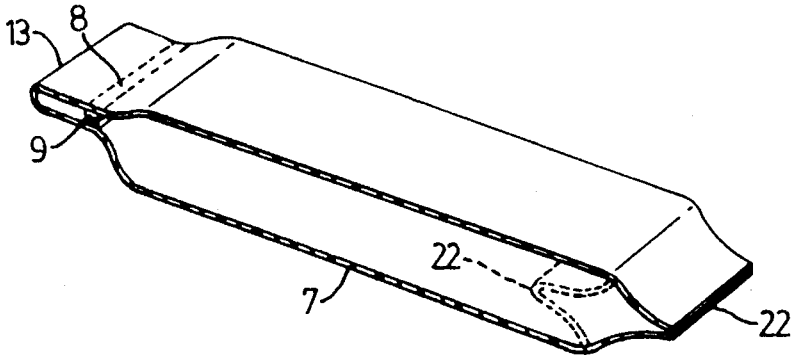
FIG. 6 is a perspective view, in section,of the bag of FIG. 5 after filling and sealing.
Figure 7:
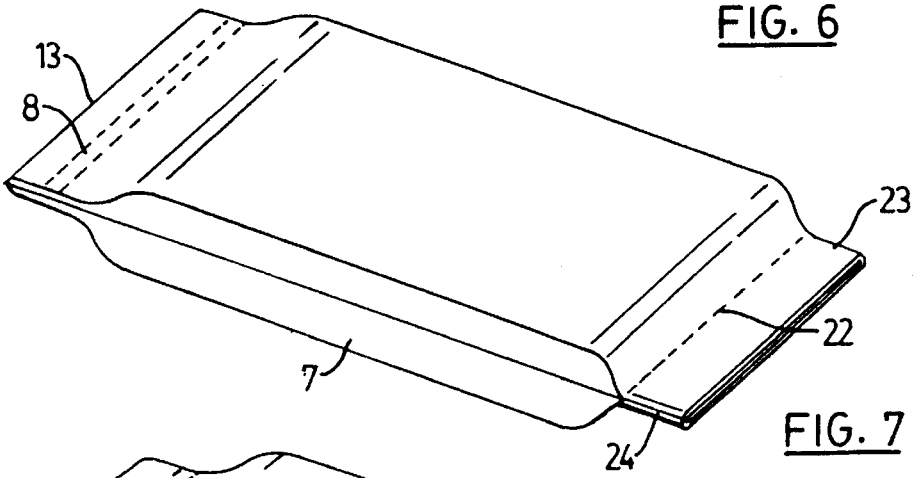
FIG. 7 is a perspective view of the bag of FIG. 6 after partial reforming.
Figure 8:
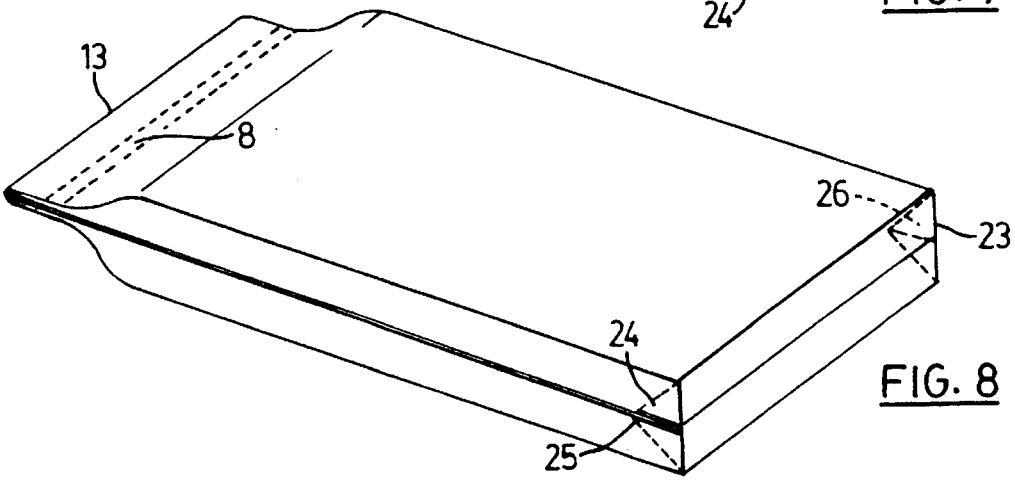
FIG. 8 is a perspective view of the bag of FIG. 5 in its final form after filling, sealing and reforming.

As shown in FIG. 5 a strip, similar to the strip used to produce the bag of FIG. 2 is cut into bags by the bag manufacturer and supplied in flat form to the packager. The packager suspends the bags from the wicket on wicket holes 20 and the bags are presented to the fill station opened between the edge 10 and the other side of the bag and filled. A flat seal 22 closes the bottom of the bag after filling and severs the surplus containing the wicket holes, producing the bag shown in FIG. 6. The bottom, formed by seal 22, is now folded revertively into the bag as shown in dotted lines in FIG. 6. The flattened sides 23 and 24 of the inwardly folded portion are sealed to the sides of the bag as shown in FIG. 7. The bag is now complete and the gusseted bottom is formed as shown in FIG. 8, when opened out. While the process of forming the bags both before and after filling has been described, no apparatus has been suggested since the initial bag forming process, folding, heat sealing and separating performed by the bag manufacturer will be well known to those skilled in the art. The filling and sealing of the bags, as supplied to the packager, may be performed by a standard fill and seal apparatus such as a machine sold by PACK-TECH International as Model 3000 Automatic Bagging System in the case of the bag illustrated in FIGS. 3 and 4. The same machine may be used for filling and sealing the bag shown in FIGS. 5–8 but some modification will be required to produce the revertive fold of the bottom edge 22 and the seal of the edges of the folded portion to the sides of the bag at 23 and 24.

It will be understood that the weight of the plastic film or laminate and the heat and pressure or other processes such as sonic sealing, required for sealing and separating will depend upon the product being bagged and the size of the bag and the material being used. The nature and colour of the plastic or laminate will also be a matter of selection but the availability of the clean perpendicular plastic surfaces is of great value, enabling attractive colourful treatment which is much sought by marketing specialists.

I claim:

1. A bag having a resealable top and a flat gusseted bottom and fillable from the bottom formed from a flat strip, said strip having a pair of matching reclosable seal members extending lengthwise of said strip near the center line thereof, said strip being folded to match said seal members and form a folded upper end of said bag, one edge of said strip being folded inwardly towards said upper end to produce a first fold and then outwardly towards the other edge of said strip to produce a second fold with said one edge extending beyond said first fold, portions of said strip being sealed and separated along transverse seams to produce a bag having an upper end including a resealable seal, a folded upper end, a pair of side seams and a single revertive pocket having ends and extending from one side seam to the other side seam and completely sealed at each of said ends to said side seams and a fill opening between said one edge and said other edge of said strip.

2. A bag as claimed in claim 1 including a tear strip adjacent said folded upper end.

3. A bag as claimed in claim 1 wherein said other edge is extended beyond said one edge and includes wicket holes by which said bag may be suspended while filling.

* * * * *